US008382231B2

(12) United States Patent
Takano et al.

(10) Patent No.: US 8,382,231 B2
(45) Date of Patent: Feb. 26, 2013

(54) INKJET PRINT HEAD AND INKJET PRINTING APPARATUS

(75) Inventors: Katsuhiko Takano, Yokohama (JP); Manabu Sueoka, Yokohama (JP); Junji Yasuda, Kawasaki (JP); Shigeo Takenaka, Kamakura (JP); Katsumasa Nishikawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 270 days.

(21) Appl. No.: 12/275,932

(22) Filed: Nov. 21, 2008

(65) Prior Publication Data

US 2009/0141062 A1 Jun. 4, 2009

(30) Foreign Application Priority Data

Nov. 30, 2007 (JP) ..... 2007-309702
Nov. 30, 2007 (JP) ..... 2007-311416
Nov. 4, 2008 (JP) ..... 2008-283335

(51) Int. Cl.
*B41J 2/05* (2006.01)

(52) U.S. Cl. ..... 347/18; 347/67; 347/63

(58) Field of Classification Search ..... 347/17, 347/18, 20, 54, 56, 63, 67
See application file for complete search history.

(56) References Cited

U.S. PATENT DOCUMENTS 5,017,941 A * 5/1991 Drake ..... 347/67
5,272,491 A * 12/1993 Asakawa et al. ..... 347/18
5,367,321 A * 11/1994 Shigenori et al. ..... 347/208
5,402,160 A * 3/1995 Kadowaki et al. ..... 347/18
5,675,366 A * 10/1997 Hayasaki et al. ..... 347/58
6,074,035 A 6/2000 Irizawa et al.
6,086,195 A * 7/2000 Bohorquez et al. ..... 347/93
6,137,506 A 10/2000 Sueoka
6,491,375 B1 * 12/2002 Fitch ..... 347/46
2002/0158945 A1 * 10/2002 Miller et al. ..... 347/61
2003/0103112 A1 * 6/2003 Shirakawa et al. ..... 347/64
2003/0150931 A1 * 8/2003 Drury et al. ..... 239/102.1
2004/0083742 A1 * 5/2004 Ruiz ..... 62/64
2005/0140722 A1 * 6/2005 Shibata et al. ..... 347/40
2007/0139469 A1 6/2007 Yasuda et al.
2009/0141063 A1 * 6/2009 Takano et al. ..... 347/18

FOREIGN PATENT DOCUMENTS

JP 8-276574 10/1996
JP 8-276575 10/1996
JP 2656834 5/1997
JP 2744475 2/1998

* cited by examiner

*Primary Examiner* — Huan Tran
(74) *Attorney, Agent, or Firm* — Fitzpatrick, Cella, Harper & Scinto

(57) ABSTRACT

A print head having high printing reliability, in which temperature unevenness is suppressed even when printing is performed using a print head having an increased length and density of an ejection opening array, can be provided. Specifically, a temperature equalizing member such as a heat pipe and a cooling liquid passage is disposed between a first support substrate and each of second support substrates or is disposed inside the first support substrate. This makes it possible to equalize temperature among the plurality of second support substrates and further equalize temperature among the printing element substrates bonded to these support substrates. In addition, the temperature equalizing member is made close to the printing element substrate, thus making it possible to efficiently equalize temperature.

14 Claims, 15 Drawing Sheets

INKJET PRINT HEAD AND INKJET PRINTING APPARATUS

BACKGROUND OF THE INVENTION

1. Field of the Invention

The present invention relates to a print head that ejects ink and an inkjet printing apparatus, and more specifically relates to a structure for cooling a print head or adjusting temperature of the print head.

2. Description of the Related Art

Conventionally, the inkjet printing apparatus using a print head that ejects ink is provided at a low running cost and is capable of being miniaturized, and therefore, has been widely used to output information of a computer apparatus and the like, and has been commercialized.

In recent years, it has been desired to obtain a print head having a longer printing width (a length of an ejection opening array) in order to achieve printing of higher resolution image at higher speed. Specifically, the print head having the ejection opening array length of 4 to 13 inches has been desired.

Thus, an increase in length and density of the ejection opening array in the print head enhances energy applied to the print head and results in a remarkable temperature rise of the print head during printing. As a result, there occurs a problem such as an increase in variation in an amount of ejection for each page, degradation in printing property for continuous printing, and the like.

Conventionally, in Japanese Patent Laid-Open No. 8-276575 (1996), Japanese Patent Publication Nos. 2656834 and 2744475, as a structure that deals with a temperature change of the print head, proposed is one in which a heat pipe and a heat releasing member are provided to a print head to cool the print head or equalize the temperature thereof.

However, the structure, described in Japanese Patent Laid-Open No. 8-276575 (1996) and the like, in which the print head is cooled or the head temperature is equalized, provides insufficient efficiency in some cases. More specifically, in the conventional structure, the heat pipe and the heat releasing member are later fitted on or externally fitted to the completed print head, causing a problem in which a distance between a printing element substrate, which is a heat source in a print head, and the heat pipe cannot be reduced sufficiently. Moreover, later fitting the heat pipe on the print head sometimes causes a problem that a contact area between the heat pipe and the print head is limited.

As described above, the conventional cooling or temperature-equalizing structure, in some cases, may provide low efficiency in cooling the print head or equalizing the head temperature, that is, may provide insufficient function. Even in the conventional structure, satisfactory effects of cooling and temperature equalizing are obtained depending on the printing condition. However, particularly when a continuous printing property is intended to be improved with the print head having an increased length and density of the ejection opening array, there is a possibility that printing defects (density unevenness and non-ejection of ink due to bubbles) due to a temperature unevenness and a temperature rise of the print head cannot be suppressed.

SUMMARY OF THE INVENTION

An object of the present invention is to provide a print head and an inkjet printing apparatus, having high printing reliability, in which temperature unevenness is suppressed even when printing is performed using a print head having an increased length and density of an ejection opening array.

In a first aspect of the present invention, there is provided an ink jet print head comprising: a plurality of printing element substrates, each printing element substrate comprising a thermal energy generating element for ejecting ink, a first support substrate, a plurality of second support substrates being supported by the first support substrate, each second support substrate supporting one printing element substrate, and a temperature equalizing member disposed between the first support substrate and the second support substrates or disposed inside the first support substrate.

According to the above structure, the temperature equalizing member such as a heat pipe or the like is disposed between the first support substrate and the second support substrate or in an inside of the first support substrate, thereby making it possible to reduce temperature unevenness among the plurality of second support substrates. As a result, it is possible to reduce temperature unevenness among the printing element substrates arranged on the second support substrates. Then, the temperature equalizing member is arranged so as to be sandwiched between the first support substrate and the second support substrate or arranged in the inside of the first support substrate, so that the temperature equalizing member can be made as close as possible to the printing element substrate, which is a heat generating source, allowing the temperature unevenness to be efficiently reduced.

Further features of the present invention will become apparent from the following description of exemplary embodiments (with reference to the attached drawings).

DESCRIPTION OF THE EMBODIMENTS

The following will specifically explain embodiments of the present invention with reference to the drawings.

FIGS. 1 to 6 are views explaining an inkjet print head and an inkjet printing apparatus in which the present invention is embodied.

Figure 1:
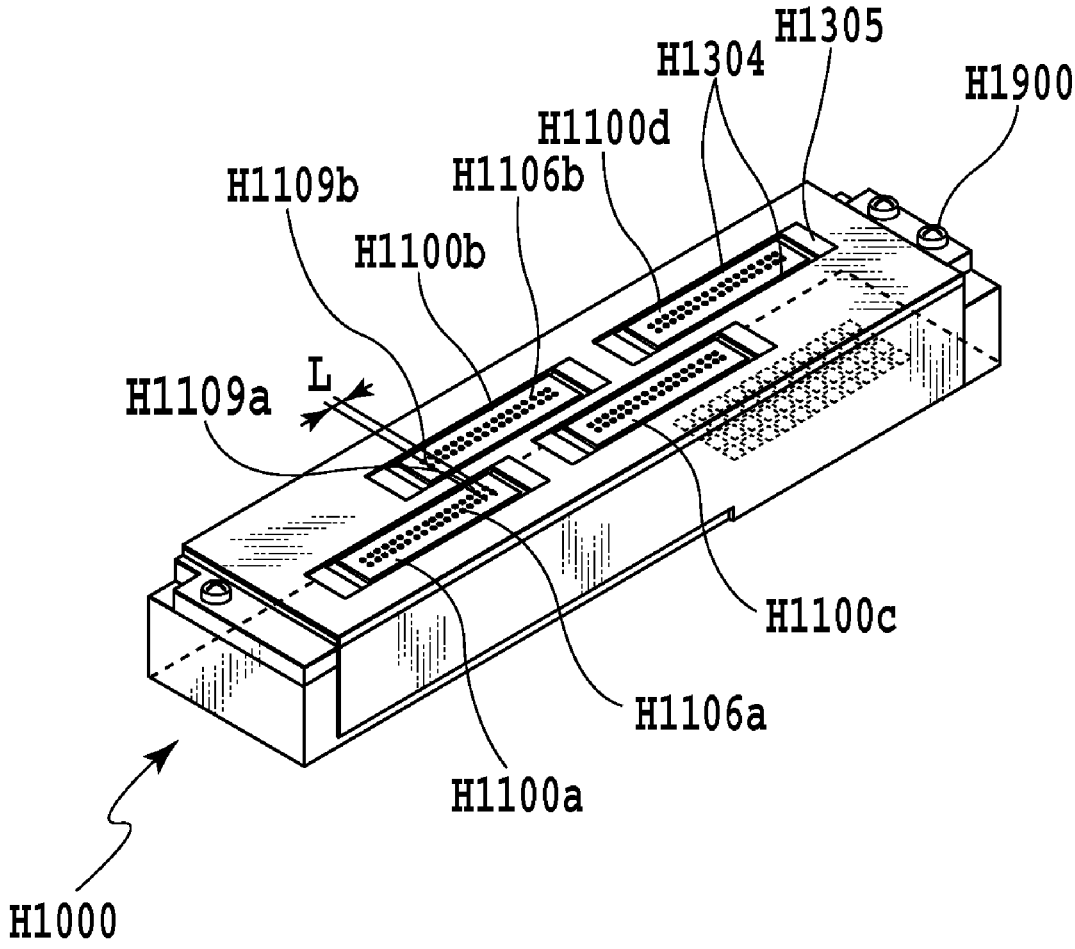
FIG. 1 is an outline perspective view of a print head according to one embodiment of the present invention.

A print head H1000 shown in FIG. 1 includes an electro-thermal transducing element as an energy generating element, which applies thermal energy to ink according to an electric signal to cause ink to form a bubble due to film boiling, thereby ejecting the ink from an ejection opening. The print head H1000 is composed of a printing element unit H1001 and an ink supply member H1500 of an ink supply unit H1002 as shown in an exploded perspective view in FIG. 2. Then, as shown in an exploded perspective view of FIG. 3, a printing element unit H1001 is constructed by having a printing element substrate H1100, a support substrate H1200, an electric wiring substrate H1300, a plate H1400, and a filter member H1600. A plurality of printing element substrates H1100 (four in an example shown in the figure) are provided, and on each printing element substrate a plurality of ejection openings are arranged as explained below. Then, respective two pairs made up of the four printing element substrates H1100 are arranged to be partially overlapped with each other in a side view (in a staggered manner), so that an array of the ejection openings having a predetermined length as an entirety of the print head is made.

Figure 4A:
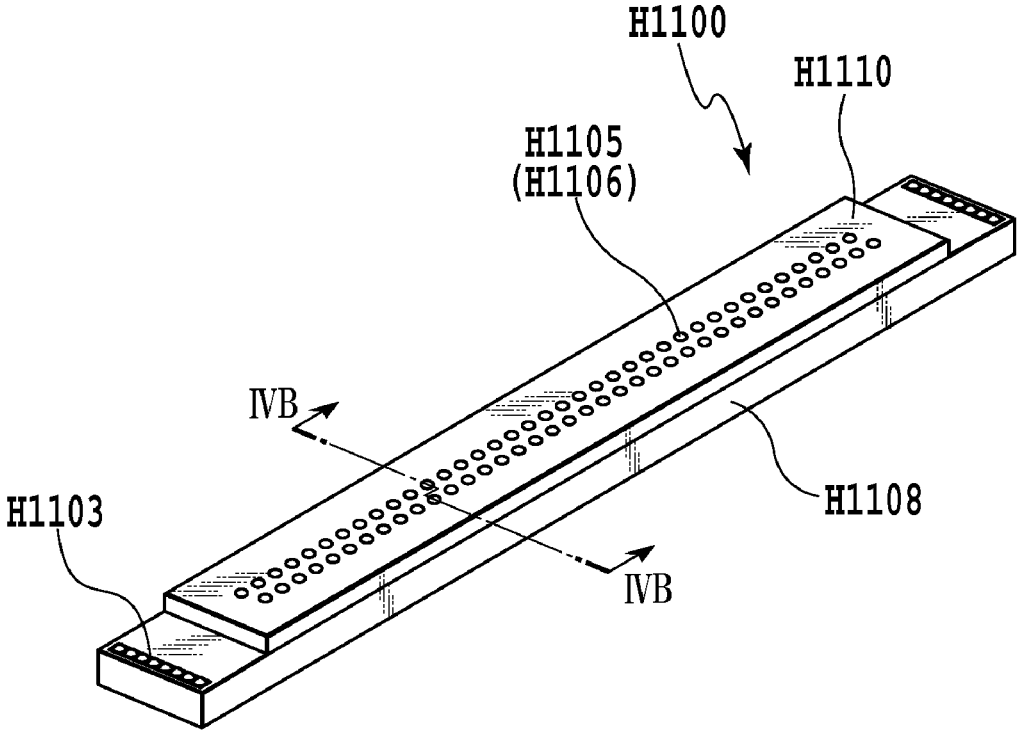
FIGS. 4A and 4B are a perspective view and a cross-sectional view to explain printing element substrates that form the above printing element unit, respectively.
Figure 4B:
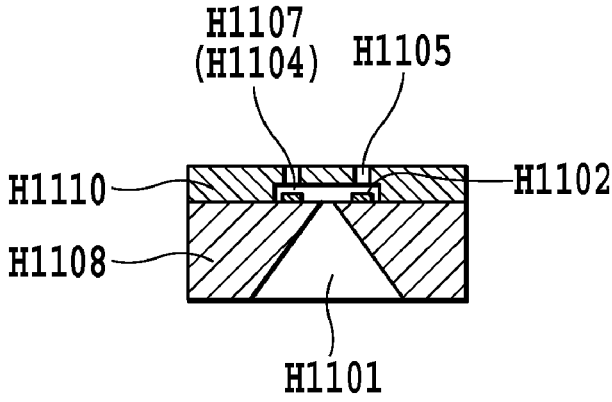

FIG. 4A is a view illustrating a specific structure of the printing element substrate H1100 and FIG. 4B is a cross-sectional view taken along a line IVB-IVB shown in FIG. 4A. The printing element substrate H1100 includes, for example, a silicon (Si) substrate H1108 of a thin film of a thickness of 0.5 mm to 1 mm. The substrate H1108 is provided with an ink supply port H1101 in the form of an elongate pass-through hole as an ink supply passage. The ink supply port H1101 is formed by anisotropic etching utilizing a crystal orientation of the Si substrate H1108. Moreover, on an upper surface of the Si substrate H1108, a plurality of electro-thermal transducing elements H1102 are arranged on both sides of an opening of the ink supply port H1101 in a staggered manner, and an electrical wiring such as A1 or the like for supplying power to these electro-thermal transducing elements 1102 is formed by a film forming technique. Further, on the upper surface of the Si substrate H1108, there are provided electrodes H1103, which are connected to the electrical wiring, for supplying power from an external part.

On the Si substrate H1108, a flow path forming member H1110 is formed to be overlaid, and the flow path forming member 1110 includes an ink flow path H1104, an ejection opening H1105 and a bubble generation chamber H1107 formed to correspond to each of the plurality of electro-terminal conversion elements H1102. Here, the ejection opening H1105 is formed to face the corresponding electro-thermal transducing element 1102. By this means, thermal energy generated by the electro-thermal transducing element H1102 causes a bubble in the ink which is supplied through the ink supply port H1101, thereby allowing the ink to be ejected from the corresponding ejection opening.

Figure 3:
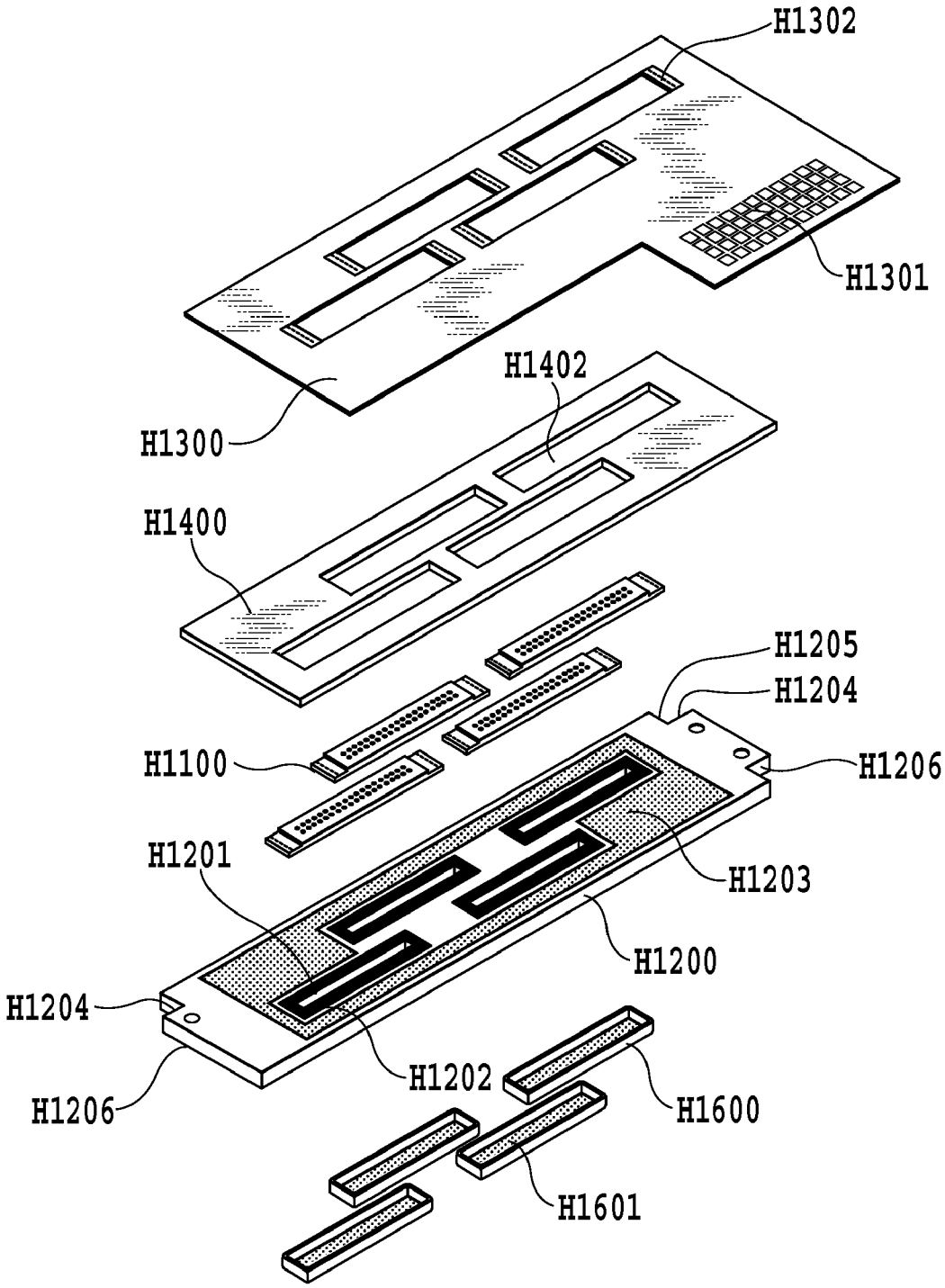
FIG. 3 is an exploded perspective view of a printing element unit that forms the print head shown in FIG. 1.

Referring to FIG. 3, the support substrate H1200 is formed of, for example, alumina (A1203) having a thickness of 0.5 mm to 1 mm. In addition, the material of the support substrate is not limited to alumina, and may be formed of material having coefficient of linear expansion, which is equal to that of the material of the printing element substrate H1100, and thermal conductivity which is equal to or higher than that of the material of the printing element substrate H1100. The material of the support substrate H1200 can be formed of any one of silicon (Si), aluminium nitride (AlN), zirconia, silicon nitride (Si3N4), silicon carbide (SiC), molybdenum (Mo), and tungsten (W). The support substrate H1200 has ink supply ports H1201 (first ink supply ports) for supplying ink to the printing element substrates H1100, respectively. Then, the ink supply ports H1201 are aligned with ink supply ports H1101 (second ink supply ports) of the Si substrate H1108, thereby allowing ink to be supplied through these supply ports. In other words, the printing element substrates H1100 are securely bonded to the support substrate H1200 with high position accuracy. Moreover, the support substrate H1200 has an X-direction reference H1204, a Y-direction reference H1205, and a Z-direction reference H1206, which can be used as positioning references. The support substrate H1200 has a cooling liquid passage formed inside as a member having a cooling function, as later-described in connection with each embodiment of the present invention.

The above-structured printing element substrates H1100 are arranged on the support substrate H1200 in the staggered manner as shown in FIG. 1 to allow printing in a large printing width (the foregoing length of an ejection opening array with the predetermined value) for a single color. For example, four printing element substrates H1100*a*, H1100*b*, H1100*c* and H1100*d*, each having an ejection opening array required to be 1 inch long or more in consideration of a portion overlaid in a side view, are arranged so as to be partially overlaid on one another in a side view, thereby making it possible to perform printing with a width of four inches.

Moreover, an end portion of the ejection opening array of each printing element substrate has a region (L) overlapped with an end portion of each of the other printing element substrates adjacent to one another in a staggered manner in a printing direction, thereby preventing a gap from being formed between printing regions due to the respective printing element substrates. For example, an overlapping region H1109*a* and an overlapping region H1109*b* are formed on an ejection opening group H1106*a* and an ejection opening group H1106*b*, respectively.

As shown in FIG. 3, the electric wiring substrate H1300 transmits an electric signal for ejecting ink to the printing element substrates H1100, and has openings for inserting the printing element substrates H1100. The plate H1400 is securely bonded to a rear face of the electric wiring substrate H1300. Moreover, the electric wiring substrate H1300 has electrode terminals H1302 corresponding to the electrodes H1103 of the printing element substrates H1100, and external signal input terminals H1301, arranged on the wiring end portion of the substrate, for receiving an electric signal from the main body of the printing apparatus. Regarding the electric wiring substrate H1300 and the printing element substrates H1100, for example, the electrodes H1103 of the printing element substrates H1100 and the electrode terminals H1302 of the electrical wiring substrates 1300 are electrically connected to one another by wire bonding technique using a gold wire H1303 (not shown). As a material of the electrical wiring substrate H1300, for example, there is used a flexible wiring substrate having a two-layer structure of wires with its surface covered with a polyimide film.

As shown in FIG. 3, the plate H1400 is formed of, for example, an SUS plate having a thickness of 0.5 mm to 1 mm. It should be noted that the material of the plate is not limited to SUS and any material may be used as long as it has an ink resistance and a good planarity. Then, the plate H1400 has openings H1402 for inserting the printing element substrates H1100 securely bonded to the support substrate H1200, and is securely bonded to the support substrate.

Grooves formed by the openings H1402 of the plate and side surface of the printing element substrate H1100 are filled with a first sealant H1304 (FIG. 1) to seal electric mounting portions of the electrical wiring substrate H1300. Moreover, the electrodes H1103 of the printing element substrate H1100 are sealed with a second sealant H1305 (FIG. 1) to protect the electric connecting portions against corrosion by ink and external impacts.

Figure 2:
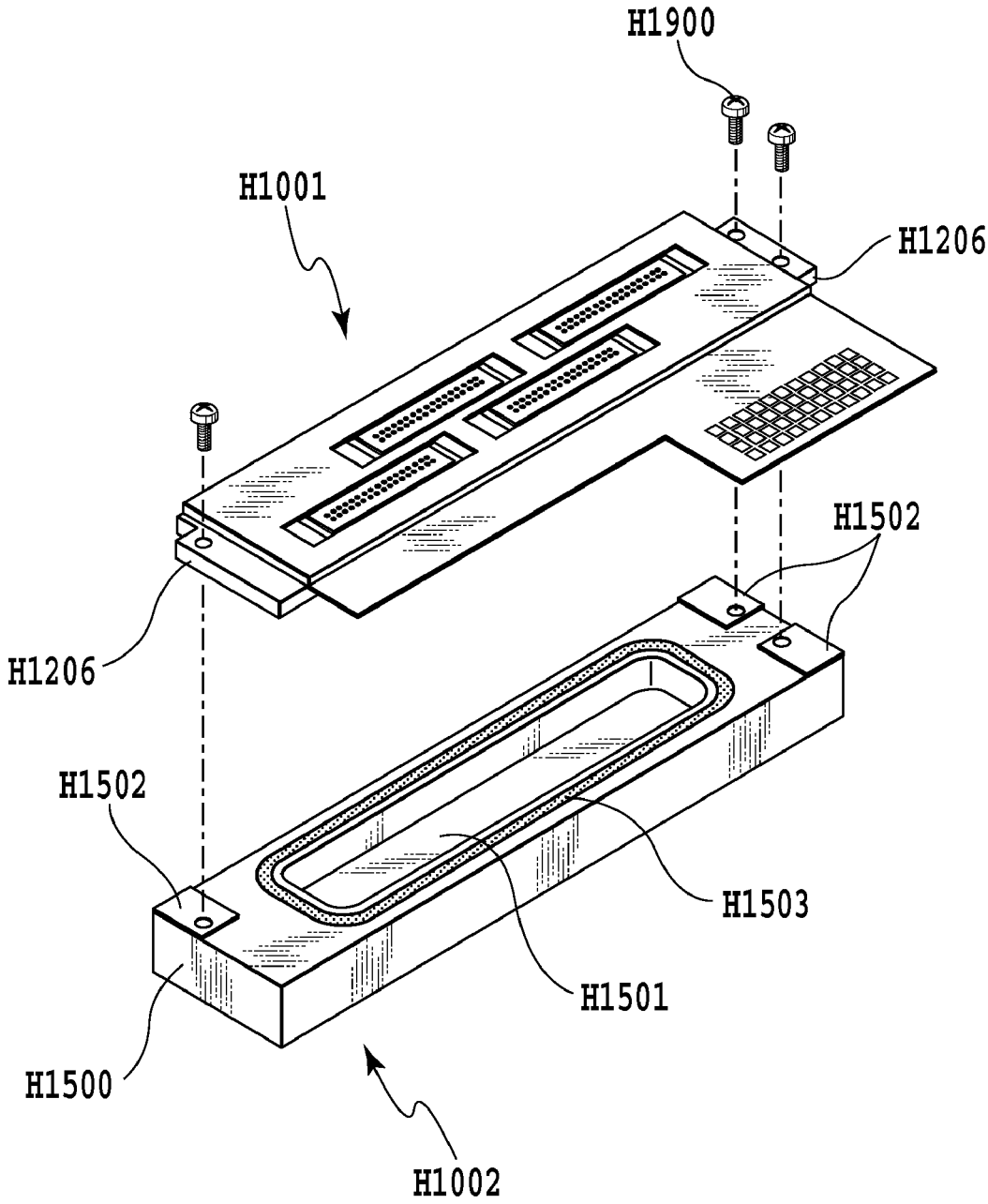
FIG. 2 is an exploded perspective view of the print head shown in FIG. 1.

Further, as shown in FIG. 3, to a part of rear face of the ink supply ports H1201 on the support plate H1200, filter members H1600 are securely bonded to remove foreign materials that have been mixed in ink. Furthermore, as shown in FIG. 2, the ink supply member H1500 is formed by, for example, resin molding, and includes a common ink chamber H1501 and a Z-direction reference plane H1502. Then, the Z-direction reference plane H1502 positions and fixes the printing element unit and serves as a Z-direction reference of the print head H1000.

As shown in FIG. 2, the print head H1000 is completed by bonding the printing element unit H1001 to the ink supply member H1500. Such bonding is performed as follows. The opening of the ink supply member H1500 and the printing element unit M1001 are sealed with a third sealant H1503 to hermetically close the common ink chamber H1501. Then, the Z-direction reference H1206 of the printing element unit H1001 is abutted against the Z-direction reference plane H1502 of the ink supply member, and they are positioned and fixed together with, for example, screws 1900. The third sealant H1503 preferably has an ink resistance, hardens at normal temperature and is flexible enough to withstand a linear expansion difference between different materials. Moreover, the portion of the external signal input terminal H1301 of the printing element unit H1001 is, for example, bent and thereafter positioned and fixed to the rear face of the ink supply member H1500 (FIG. 1).

Figure 5:
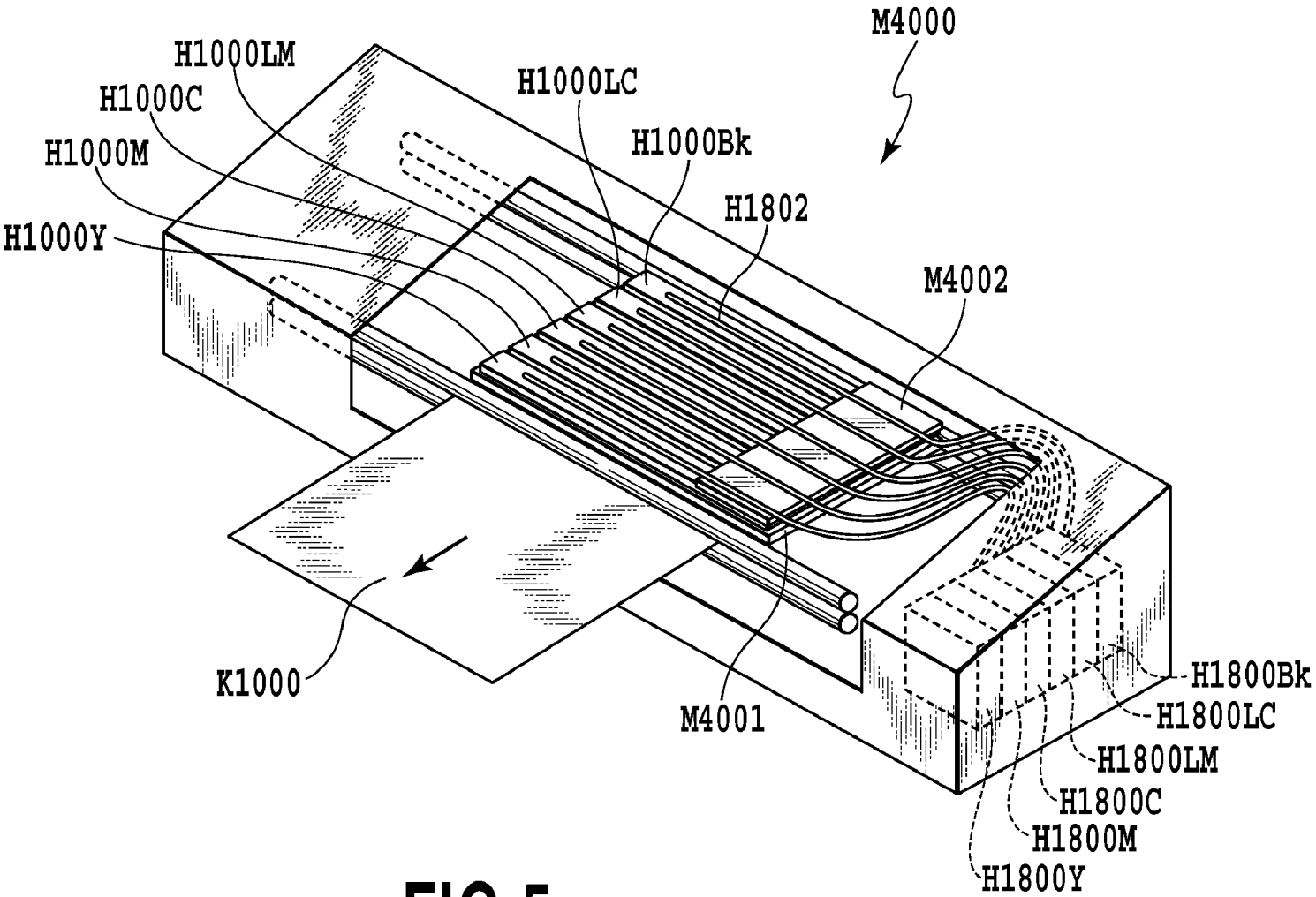
FIG. 5 is a view showing an inkjet printing apparatus according to one embodiment of the present invention.

An ink jet printing apparatus M4000 according to the embodiment of the present invention includes print heads for six colors to enable picture-quality printing, for example, as shown in FIG. 5. Here, H1800Bk is an ink tank for a black ink, H1800C is an ink tank for a cyan ink, H1800M is an ink tank for a magenta ink, H1800Y is an ink tank for a yellow ink, H1800LC is an ink tank for a light cyan ink, and H1800LM is an ink tank for a light magenta ink. Moreover, a print head H1000Bk is used for a black ink, a print head H1000C is used for a cyan ink, a print head H1000M is used for a magenta ink, and a print head 1000Y is used for a yellow ink. Furthermore, a print head H1000LC is used for a light cyan ink, and a print head H1000LM is used for a light magenta ink. Moreover, H1802 indicates an ink supply tube for supplying ink to the corresponding print head from each ink tank. These print heads H1000 are securely supported by a positioning mechanism of a carriage M4001 and an electrical contact M4002 mounted on the printing apparatus main body M4000. Then, these print heads are controlled by a drive circuit, which is not illustrated, to perform printing onto a printing medium.

Figure 6:
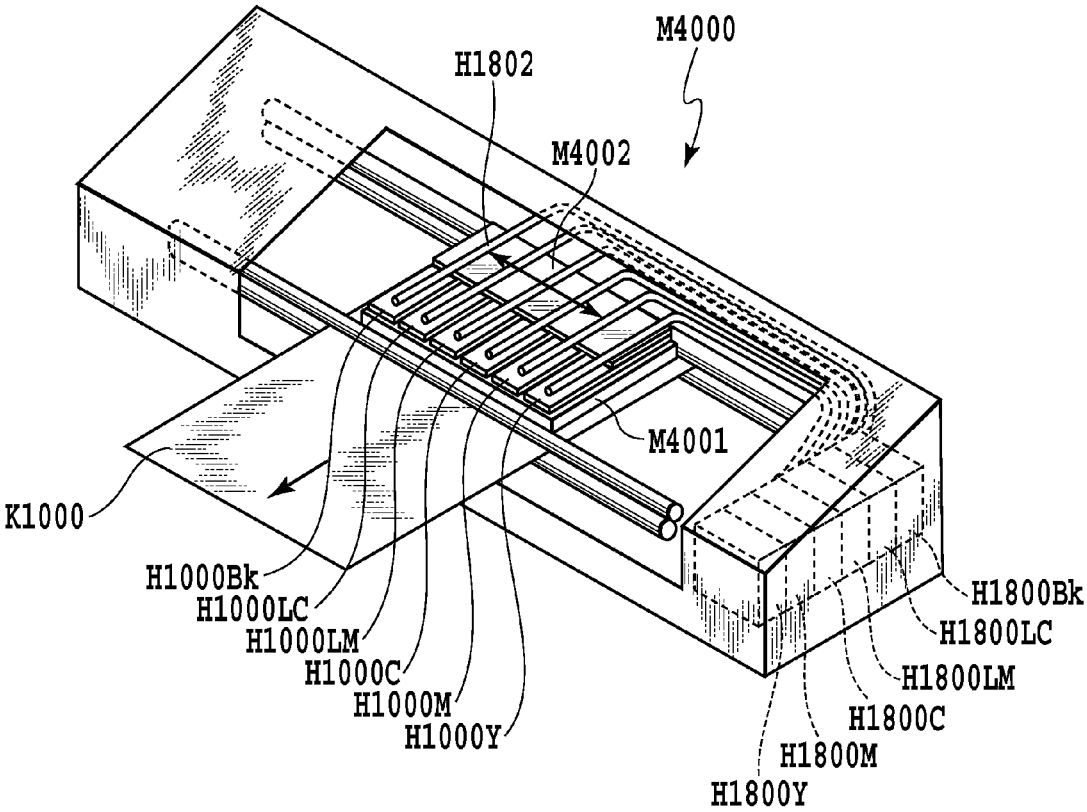
FIG. 6 is a view showing an inkjet printing apparatus according to another embodiment of the present invention.

In addition, the printing apparatus shown in FIG. 5 is a full line type where the print heads have ejection openings corresponding to the width of the printing medium. Namely, this is the system in which printing is performed in such a manner that a printing medium K1000 is moved in an arrow direction with the print heads fixed. In contrast to this, the printing apparatus shown in FIG. 6 is a serial-drive type printing apparatus that performs printing while reciprocating in a main scanning direction (carriage moving direction) with the print heads mounted on a head carriage M4001. It is obvious from the following explanation that the present invention can be applied to the print heads used in the serial type printing apparatus.

First Embodiment

A first embodiment of the present invention is one that has a double-layered structure of support substrates that support printing element substrates. The support substrate is thus formed to have the double-layered structure of a first support substrate and a second support substrate, thereby making it possible to miniaturize the second support substrate bonded to the printing element substrate. By this means, it is possible to manufacture the second support substrate in a molding process at low cost with high accuracy. Moreover, the first support substrate does not need high position accuracy of ink supply ports or the like. As a result, a green sheet laminating method, in which a green sheet is punched to have a desired shape and the resultant sheet is laminated and calcined, can be applied to the first support substrate, and therefore even a large size support substrate can be manufactured at low cost. Further, in the present embodiment, for the first support substrate, it is possible to use materials which do not have high thermal conductivity as compared with the second support substrate. For example, materials, having thermal conductivity lower than that of alumina, can be used. According to this embodiment, it is possible to use materials, which have not been singly used due to their poor heat release regardless of their excellent dimensional stability at the time of molding. This makes it possible to reduce cost and to prevent a reduction in dimensional accuracy at the time of molding even in a case of large-size print heads.

Further in the first embodiment of the present invention, a heat pipe is disposed between the first support substrate and the second support substrate in the aforementioned double-layered structure of the support substrates. More specifically, the print head having the double-layered structure of support substrates is provided in such a manner that plurality of miniaturized second support substrates are overlaid on one first support substrate. In this case, there is difficulty in transmitting heat of one second support substrate, which is subjected to heat from the printing element substrate, to an adjacent second support substrate. As a result, a problem may arise in which temperature unevenness occurs between the second support substrates to generate a difference in a temperature rising state for each printing element substrate mounted on the second substrate, causing deterioration in printing quality due to variation in an ink ejection amount, and the like. In order to prevent the above problem, the heat pipe is disposed between the first support substrate and the rear surfaces of the second support substrates having the printing element substrates arranged, thereby making it possible to prevent temperature unevenness from occurring among the plurality of support substrates. As a result, it is possible to reduce temperature unevenness among the printing element substrates provided on the second support substrates. Then, the heat pipe is disposed and sandwiched between the first support substrate and the second support substrates, so that the heat pipe can be made close to the printing element substrates, which are heat generating sources, as much as possible, allowing the temperature unevenness to be efficiently reduced.

Furthermore, in the first embodiment, a liquid passage for cooling (cooling liquid passage) is provided in an inside of the first support substrate. By this means, a cooling liquid in the cooling liquid passage can efficiently receive and discharge heat generated by the printing element substrates through the second support substrates. As a result, it is possible to appropriately suppress the temperature rise of the printing element substrates.

Figure 7A:
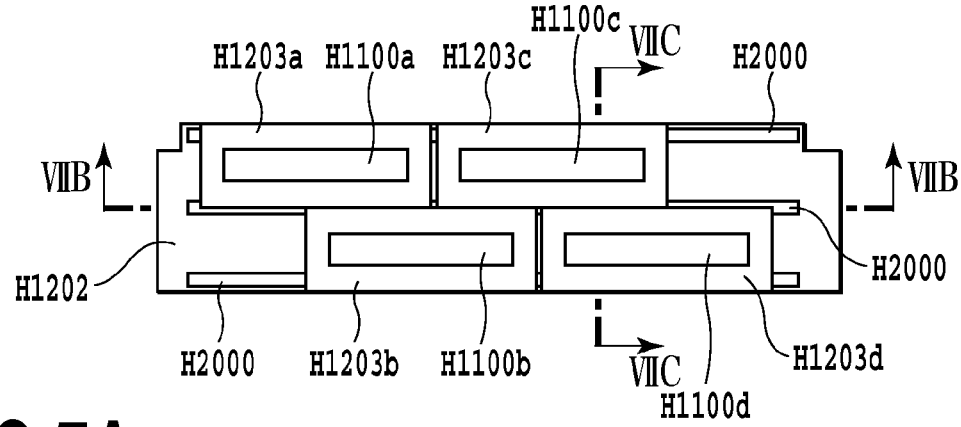
FIGS. 7A, 7B and 7C are a front view showing arrangement of a cooling system and heat pipes in the print head in FIG. 1, a cross-sectional view taken along a line VIIB-VIIB, and a cross-sectional view taken along a line VIIC-VIIC, respectively.
Figure 7B:
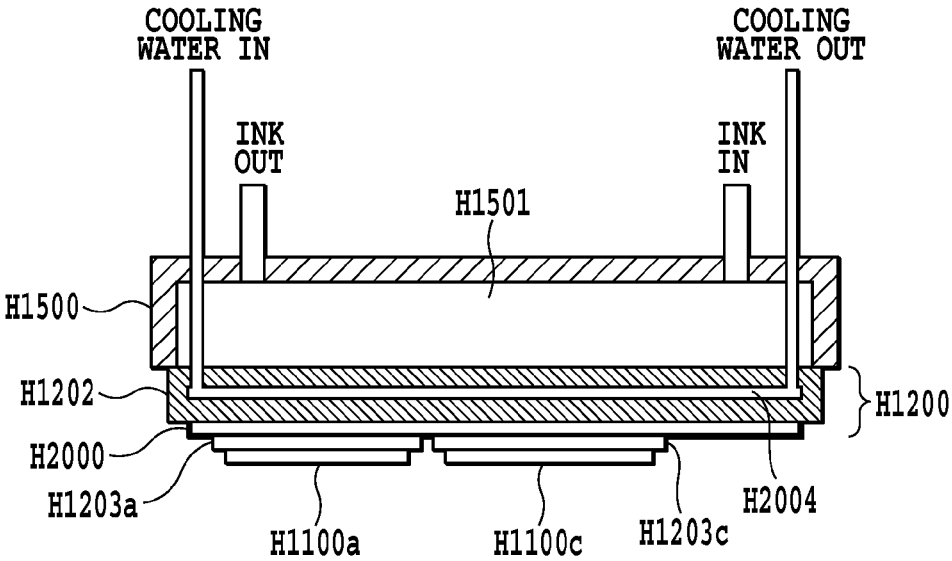
Figure 7C:
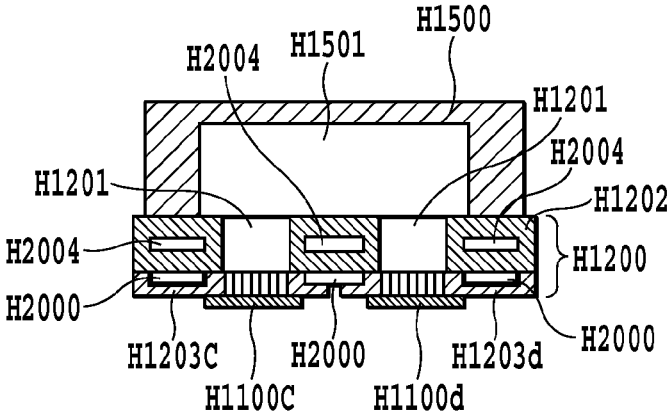

FIG. 7A is a front view of the print head of the first embodiment of the present invention seen from the printing element substrate side. It should be noted that an electric wiring substrate is excluded to simplify the drawing. FIG. 7B is a cross-sectional view taken along a line VIIB-VIIB in FIG. 7A, and FIG. 7C is a schematic view showing a cross-section taken along a line VIIC-VIIC in FIG. 7A.

As shown in these figures, the support substrate H1200 is formed by bonding with an adhesive the first support substrate H1202, which is produced by laminating and calcinating an alumina green sheet, to the second support substrates H1203*a*, H1203*b*, H1203*c* and H1203*d*, which are produced with high accuracy by molding alumina. In other words, a double-layered structure, which includes one first support substrate and four second substrates, is formed. Printing element substrates H1100*a*, H1100*b*, H1100*c* and H1100*d* are mounted on the four second support substrates, respectively. Four printing element substrates are arranged in a so-called staggered manner where respective two pairs of ejection opening arrays are arranged to be partially overlapped with each other in a side view. The print head of the present embodiment is a so-called full-line type print head where the ejection openings are arranged in a range corresponding to the width of a printing medium to be transferred. Ink in a common liquid chamber H1501 is circulated by ink circulation mechanism (not shown).

As shown in the cross-sectional views of FIGS. 7A and 7C, three water passages H2004 for cooling water are formed in an inside of the first support substrate H1202 by a manufacturing method to be described later in FIG. 8. These water passages are connected to a circulation mechanism (not shown), provided outside of the print head, for circulating cooling water. The liquid passages for a cooling liquid (cooling liquid passage) are thus provided in the support substrates, so that the cooling liquid passages can be made as close as possible to the printing element substrates, which are heat generating sources, allowing heat generated by the printing element substrates to be efficiently discharged.

Moreover, each of three heat pipes H2000 is sandwiched between the first support substrate H1202 and each of the second support substrates H1203*a*, H1203*b*, H1203*c*, and H1203*d* through an adhesive having high thermal conductivity (not shown). In addition, although each heat pipe H2000 is illustrated in a rectangular cross-section (FIG. 7C), the heat pipe 2000 actually has a thin flat cross-section. Moreover, the heat pipes H2000 are fit into concave portions formed in either the second support substrates H1203*a* to H1203*d* or the first support substrate H1202 or both. Here, in a case where the concave portions are formed on the second support substrate side, the heat pipes are made close to the printing element substrates as heating sources, thus making it possible to further accelerate temperature equalizing. On the other hand, in a case where the concave portions are formed on the first support substrate side, the first support substrate is formed using the green sheet laminating method to be described in FIG. 8, thus making it possible to form the concave portions at low cost.

Among these three heat pipes H2000, two heat pipes formed on both sides come in contact with two second support substrates (through the adhesive) and one heat pipe formed at the center comes in contact with four second support substrates (through the adhesive). In other words, the heat pipes are provided onto the second support substrates, which are provided to correspond to individual printing element substrates, respectively, to be in contact therewith. This makes it possible to equalize temperature among the plurality of second support substrates and further equalize temperature among the printing element substrates bonded to these support substrates, respectively. In addition, each heat pipe is disposed between the first support substrate and the second support substrate, thus allowing the heat pipe to be made close to the printing element substrate and thus making it possible to efficiently equalize temperature with the heat pipe.

Figure 8:
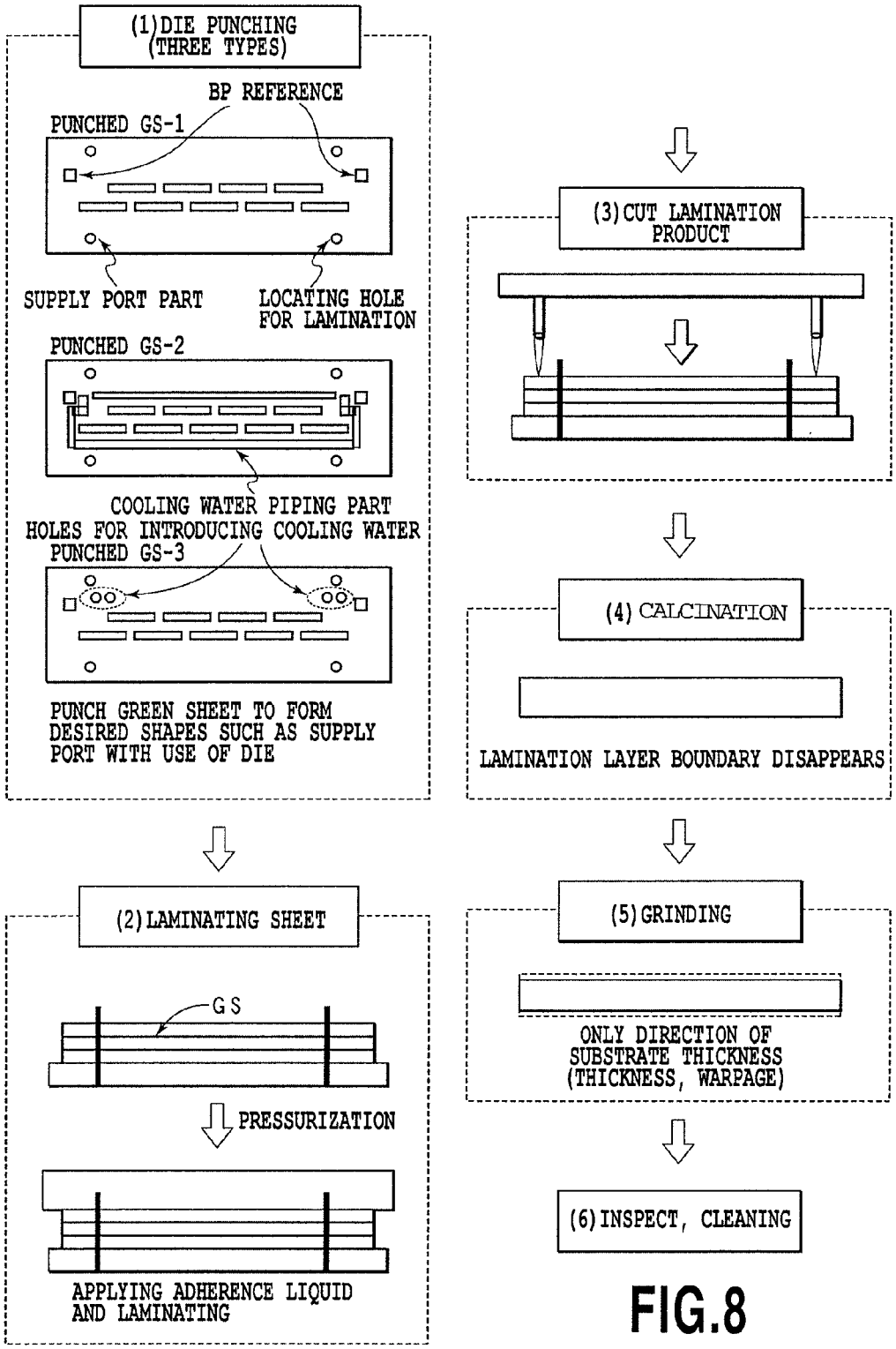
FIG. 8 is a view explaining a manufacturing process of a print head support substrate using a green sheet laminating method according to one embodiment of the present invention.

FIG. 8 is a view schematically showing a procedure for manufacturing the aforementioned first support substrate H1202 by the green sheet laminating method. As shown in the same figure, in this procedure, (1) the number of green sheets, which constitutes a support substrate, is three in the present embodiment, and each is punched by a dedicated punching die. (2) Next, adherence liquid is applied to the resultant sheets, and these sheets are laminated and pressurized so as to be assembled into a shape of the support substrate. (3) Next, an outline of the assembled lamination product is cut to decide a final outer shape, and (4) the resultant shape is charged into a heating furnace to be calcined. (5) After that, the front and rear surfaces of the support substrate are grinded to produce surface accuracy.

In a case where the first support substrate is manufactured in the above processes, the supply ports are formed before calcination, and during the calcination, deformation of the substrate such as curing shrinkage, warpage, or the like may occur, and hence sufficient positional accuracy of the supply ports may not be obtained. However, in terms of the cost, it is possible to manufacture the first support substrate at low cost as compared with the first support substrate having grooves and supply ports additionally formed after calcination. On the other hand, as for the second support substrate, more complicated ink flow paths than those of the first support substrate are formed in many cases, and the second support substrate needs to be securely bonded to the printing element substrate with high positional accuracy of the ink supply port H1101 of the printing element substrate with respect to the second support substrate, and therefore high accuracy is required for manufacturing the second support substrate. Accordingly, in terms of dimensional accuracy, there is difficulty in manufacturing four second support substrates by integral molding method. However, if they are individually small-sized so as to suit the printing element substrate as in this embodiment, manufacturing by the molding method may be possible and they can be manufactured at low cost.

The foregoing first and second support substrates are formed of, for example, alumina (A1203) having a thickness of 3 mm to 10 mm. In addition, the material of the support substrate is not limited to alumina, and may be formed of material having coefficient of linear expansion, which is equal to that of the material of the printing element substrate H1100, and thermal conductivity which is equal to or higher than that of the material of the printing element substrate H1100.

As a material of the first support substrate, considered are, for example, silicon (Si), carbon graphite, zirconia, silicon nitride (Si3N4), silicon carbide (SiC), molybdenum (Mo), and tungsten (W). Moreover, as a material of the second support substrate, it is possible to use Zi-ma manufactured by Sumitomo Osaka Cement and resin material with an increased filling factor of filler and improved thermal conductivity (for example, PPS manufactured by Toray), in addition to the materials of the first support substrate. As an adhesive for support substrates, preferably used are one having a low viscosity, a thin adhesive layer formed on a contact surface, a relatively high hardness after curing, and high ink resistance. For example, it is preferable to use a thermosetting adhesive containing epoxy resin as a main component or UV cure type thermosetting adhesive having an adhesive layer with a thickness of 50 μm or less. Particularly, the thickness is preferably 10 μm or less in consideration of the point that heat of the printing element substrate H1100 generated by printing is released to the support substrate H1200 side.

As described above, the second support substrate is divided into plurality of substrates, resulting in the structure in which the temperature rise of the printing element substrate generated during printing is hardly transmitted to the adjacent substrate, and therefore a need arises for a structure in which temperature equalizing is obtained between the second support substrates. In the present embodiment, the heat pipe is sandwiched between the first support substrate and the second support substrates through an adhesive having a high thermal conductivity to allow temperature equalizing of the temperature rise between the printing element substrates due to a printing operation. In insertion of the heat pipe, two cases can be considered: one in which the heat pipe is mounted when the first support substrate and the second support substrates are bonded to each other, and the other in which it is mounted after thermal processes of various types. The heat pipe is preferably mounted after a thermal process in terms of coefficients of linear expansion between alumina and the heat pipe.

Second Embodiment

A second embodiment of the present invention relates to a two-layer structure of the first support substrate, and the other points are the same as those mentioned in the first embodiment.

Figure 9A:
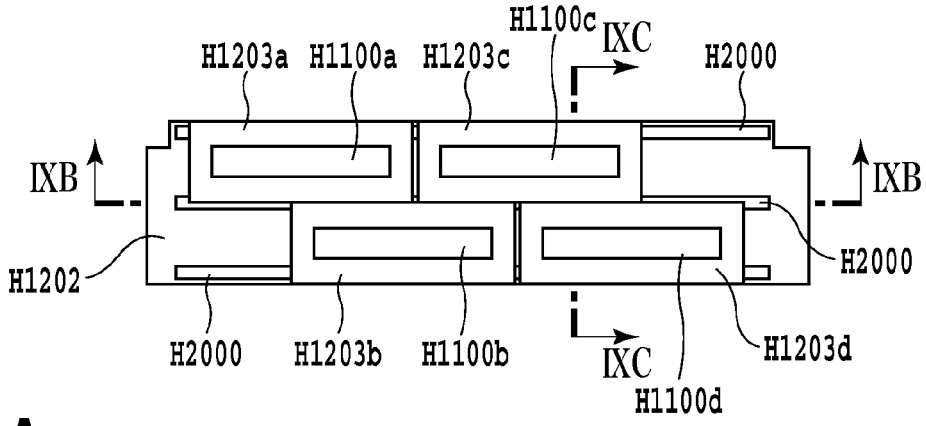
FIGS. 9A, 9B and 9C are a front view showing arrangement of a cooling system and heat pipes in a print head according to another embodiment of the present invention, a cross-sectional view taken along a line IXB-IXB, and a cross-sectional view taken along a line IXC-IXC, respectively.
Figure 9B:
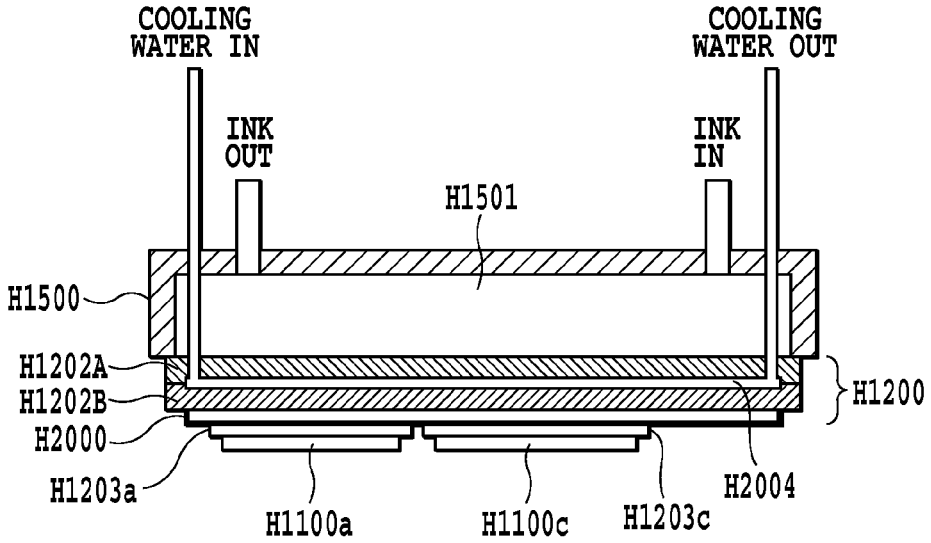
Figure 9C:
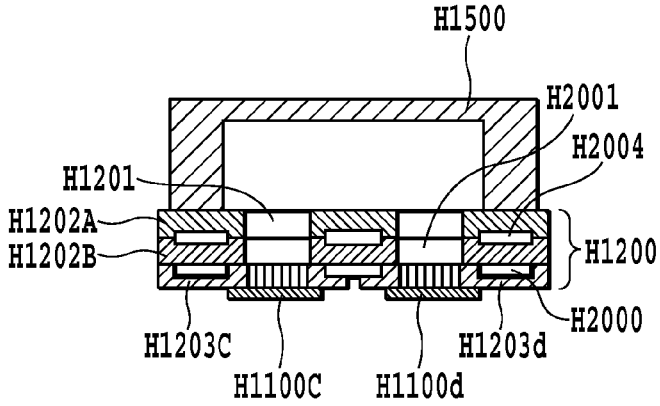

FIGS. 9A to 9C are views mainly explaining first and second support substrates according to the second embodiment and similar to FIGS. 7A to 7C. As shown in FIGS. 9B and 9C, the first support substrate is formed by bonding two layers of support substrates H1202A and H1202B to each other. More specifically, two substrates H1202A and H1202B are formed of Zi-ma manufactured by Sumitomo Osaka Cement and these substrates are bonded to each other to form the first support substrate (H1202).

According to the present embodiment, thermal conductivity of the first support substrate is somewhat reduced as compared with that described in the first embodiment, but dimensional accuracy in molding materials can be increased. This makes it possible to manufacture ink flow path formed in the support substrate with high accuracy, improve assembling performance, and achieve a significant cost reduction.

Third Embodiment

The print head according to a third embodiment of the present invention differs from that in the first embodiment in the point that silicon carbide is used as a material and a second support substrate is formed by molding this material, and the other points are the same as those mentioned in the first embodiment. The thermal conductivity of silicon carbide is 200 W/m·K, which is higher than that of alumina of about 30 W/m·K. By this means, even when temperature of the printing element substrate rises, an amount of heat to be released through the second support substrates can be relatively increased, and the temperature rise of the print head can be further suppressed, coupled with a cooling effect by a cooling liquid passage formed in the first support substrate. The heat pipe used in the respective embodiments will be further explained as follows:

A commercially available heat pipe can be used as a heat pipe of the embodiments. Any shape is possible if a contact area with the support substrate is retained; however, a flattened pipe shape is preferably used from the viewpoint of groove workability and a head structure. Moreover, as a material that fills a gap between the heat pipe and the support substrate, any material is possible if it has a high and stable thermal conductivity, and a silicon-based adhesive or grease can be used.

In the aforementioned embodiments, it should be noted that the heat pipe is used as a member that is connected to each of the plurality of second support substrates to equalize temperature of these substrates. However, the present invention is not limited to this member and any member may be, of course, used if the member transfers heat quickly by good heat conductivity.

Moreover, materials having rigidity, ink resistance, and good thermal conductivity are preferably used as the material of the aforementioned support substrate, and ceramic materials are mainly used. Among the ceramic materials, particularly alumina costs relatively low and has rigidity, and therefore is suitable for a print head having an increased length in which warpage or waviness is likely to become a problem. Particularly, an alumina substrate formed by laminating and calcinating a green sheet is preferable since it can be manufactured at low cost even when it is used for the complicated structure as in the print head of the present invention. Regarding arrangement of the heat pipes and cooling liquid passages onto the support substrates, it is preferable that the heat pipes and the cooling liquid passages be made close to the printing element substrates, serving as heat sources, as much as possible. This makes it possible that the heat pipes perform temperature equalizing on a distribution of temperature of the support substrate with a good heat exchanging efficiency and a cooling liquid performs cooling, the distribution of temperature being partially increased by the temperature rise of the printing element substrate, used in printing, among the plurality of printing element substrates. Accordingly, a structure is provided in which the heat pipes are proximately arranged so as to be placed among the first and second substrates to thereby correct unbalanced heat between the second support substrates, release the heat to the first support substrate side, and make cooling water flow into cooling pipes. The aforementioned structure makes it possible to reduce the temperature distribution in the print head and suppress the temperature rise. As a result, even when printing is performed with high density at high speed, it is possible to prevent occurrence of partial density unevenness of ink and ink non-ejection and to print high quality image at high speed.

Additionally, in the case of installing only the heat pipes, only an effect resulting from temperature equalizing can be expected. However, since no cooling may be required depending on the printing condition, an effect of high-resolution printing can be expected. It is preferable that the cooling structure be also provided when printing is continuously performed at high speed, and one side of the heat pipe may be extended from the support substrate and connected to a cooling member such as a heat sink to thereby allow cooling. In this case, it is possible to provide both effects of temperature equalizing and cooling of the print head.

In addition, water, ink, air, nitrogen gas, and the like can be used as a cooling liquid or a cooling medium, and particularly when a temperature-adjusted medium is used in a circulation manner, temperature management and control are facilitated. Moreover, in a case where the cooling liquid passage is divided into plurality of passages, it is possible to precisely control temperature of the print head on the basis of the direction to which the cooling liquid flows and the number of passages.

Figure 10:
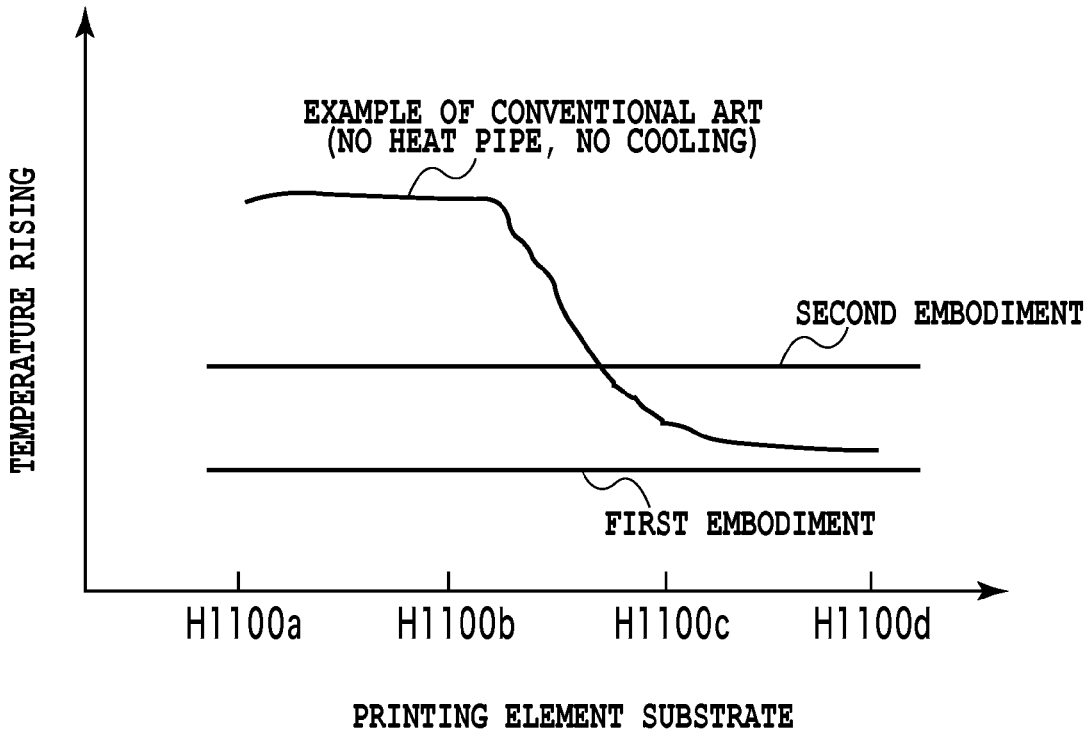
FIG. 10 is a view explaining comparison in a temperature rising state between the print head of the embodiment of the present invention and the conventional print head.

FIG. 10 is a view explaining comparison between the print head of embodiments of present invention and the conventional print head having neither heat pipes nor cooling liquid passages, on the basis of a print head temperature (an amount of the temperature rise) at the time point when 50 sheets are printed. Among four chips of the printing element substrates, used here are only substrates H1100*a* and H1100*b* and substrates H1100*c* and H1100*d* are not used. As shown in FIG. 10, in the case of the conventional print head, the printing element substrates H1100*a* and H1100*b* reach high temperature when about 50 sheets are printed, and the temperature continues to rise, resulting in occurrence of ink non-ejection. In contrast to this, in the first embodiment of the present invention, the temperature rise of the used printing element substrates 1100*a*, 1100*b* and the temperature rise of the unused printing element substrates 1100*c* and H1100*d* are substantially the same, namely the temperature is equalized. Then, by this equalization, the temperature rise is saturated when 50 sheets are printed and the amount of the temperature rise is suppressed to a half of the conventional print head. Moreover, even when printing is further continued, non-ejection does not occur. Next, in the print head of the second embodiment, saturation temperature is slightly higher than that in the first embodiment; however, a temperature difference in the length direction of the print head can be suppressed to a degree which causes no problem. Additionally, the amount of temperature rise ($\Delta T$) is changed depending on a heat transport amount through the heat pipe, a shape of cooling liquid passage, a flow rate of cooling liquid, and temperature; however, this may be, of course, set to an optimal condition according to the specification of the print head to be used.

Fourth Embodiment

Figure 11A:
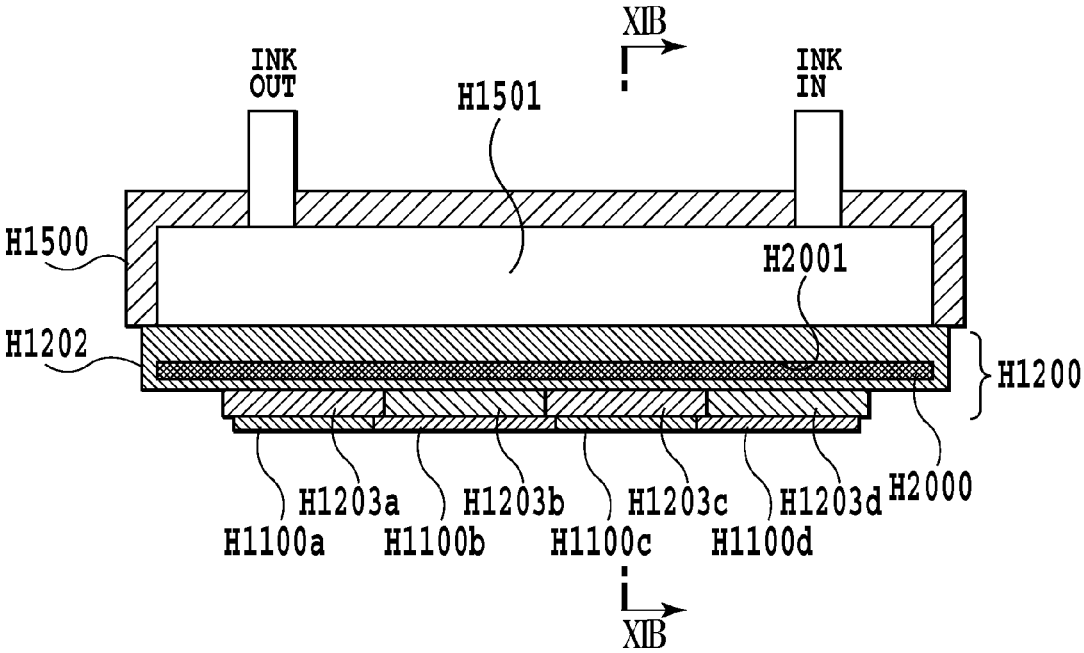
FIGS. 11A and 11B are cross-sectional schematic views of a print head according to a fourth embodiment of the present invention.
Figure 11B:
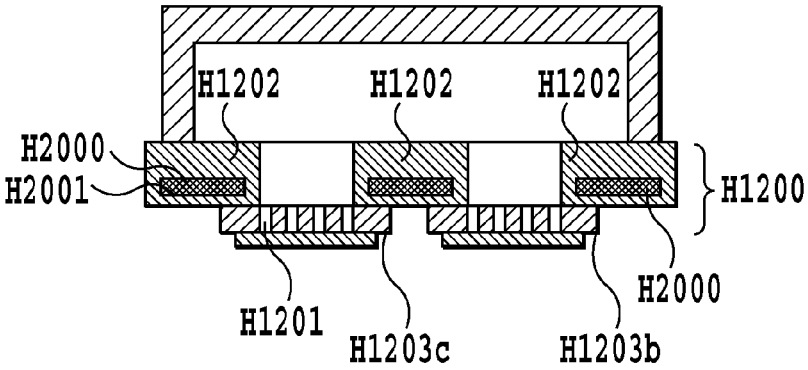

The first to third embodiments have described that the heat pipe is disposed between the first support substrate and the second support substrates, whereas, a fourth embodiment of the present invention relates to a case in which a heat pipe is provided in an inside of the first substrate. FIGS. 11A and 11B are cross-sectional views each showing an inkjet print head according to the fourth embodiment of the present invention, and FIG. 11A is a longitudinal cross-sectional view and FIG. 11B is a cross-sectional view taken along line XIB-XIB of FIG. 11A. A support substrate H1200 has a two-layered structure including a first support substrate H1202 and a second support substrate H1203 (H1203*a*, 1203*b*, H1203*c*, H1203*d*) bonded to each other with an adhesive. As later-described in FIG. 12, the first support substrate H1202 is produced by laminating and calcinating a green sheet of alumina (Al203), and the second support substrate H1203 is produced with high accuracy by molding alumina. On the support substrate H1200, four printing element substrates H1100*a*, H1100*b*, H1100*c* and H1100*d* are mounted in a staggered manner such that their end portions are overlaid on one another in the printing direction.

In an inside of the first support substrate H1202, a space H2001 for installing a heat pipe H2000 is formed. A cross-section of a groove for installing the heat pipe has a width of 4.2 mm and a depth of 2.2 mm. The thin flat heat pipe H2000, having a cross-section with a width of 4 mm and a thickness of 2 mm, is fixed to the support substrate H1202 by filling a gap between the space H1201 and the heat pipe H2000 with a silicon adhesive. Moreover, the second support substrate H1203 has an ink supply port H1201 formed therein.

Figure 12:
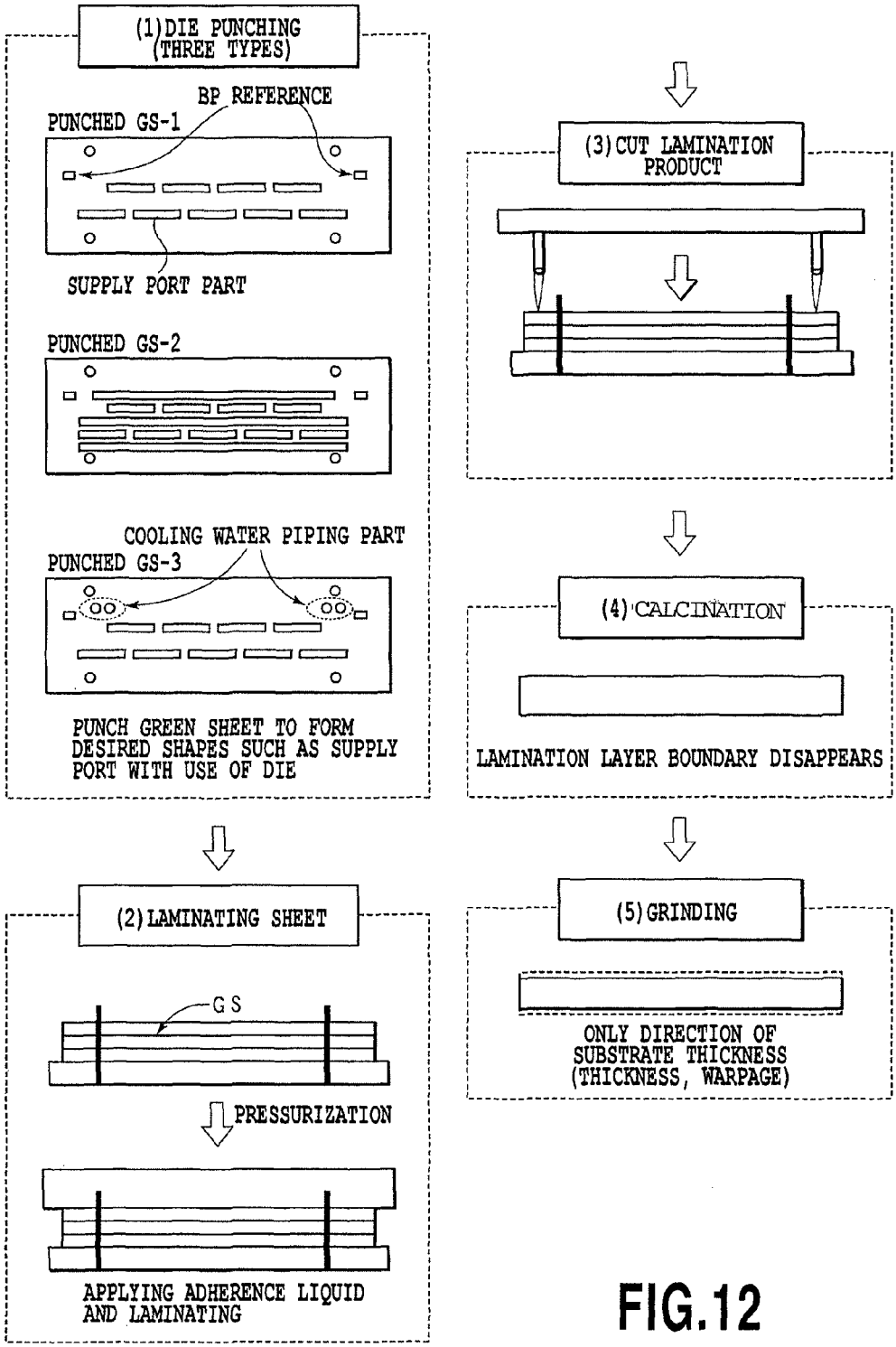
FIG. 12 is a view schematically explaining a manufacturing process of a first support substrate using a green sheet laminating method.

FIG. 12 is a view schematically showing processes for manufacturing the first support substrate H1202 by a green sheet laminating method.

(1) Each of plurality of green sheets, which constitute the first support substrate H1202, is punched into a predetermined shape (e.g., an opening of the supply section that communicates with the ink supply port H1201) by a dedicated punching die (die punching process).

(2) Next, adherence liquid is applied to the resultant green sheets, and these sheets are laminated and pressurized so as to be assembled into a shape of a first support substrate H1202 having an insertion space for a heat pipe H2000 (sheet laminating process).

(3) Sequentially, an outline of the assembled lamination product is cut to decide a final outer shape (lamination product cutting process).

(4) Then, the lamination product having the decided outer shape is carried into a heating furnace to be calcined (calcination process).

(5) After that, the front and rear surfaces of the lamination product subjected to calcination are grinded to produce predetermined surface accuracy (grinding process).

The first support substrate H1202 manufactured through the aforementioned processes is subjected to the calcination process after forming the opening of the supply section or the like, and therefore sufficient positional accuracy of an ink supply port H1201 may not be obtained. However, in the foregoing manufacturing method, the support substrate can be manufactured at extremely low cost as compared with the support substrate having the space H1201 and the opening of the ink supply section additionally formed for accommodating heat pipe H2000 after calcination. Thus, the support substrate can be formed to have a structure including the first support substrate using the green sheet laminating method and the second support substrate manufactured with high accuracy by the molding method, thereby making it possible to provide a print head at lower cost.

Further, regarding the positional accuracy of the ink supply port H1201, the second support substrate H1203 is manufactured with high accuracy by the molding process and securely bonded to the first support substrate H1202 with high positional accuracy. By this means, it is possible to manufacture an inkjet print head having substantially no problem in the positional accuracy of the printing element substrate H1100 with respect to the ink supply port H1101 of the printing element substrate.

According to the present embodiment, the heat pipe H2000 is provided inside the support substrate H1200, thereby allowing improvement in temperature of the inkjet print head, particularly temperature equalizing between the respective printing element substrates H1100.

Fifth Embodiment

Figure 13A:
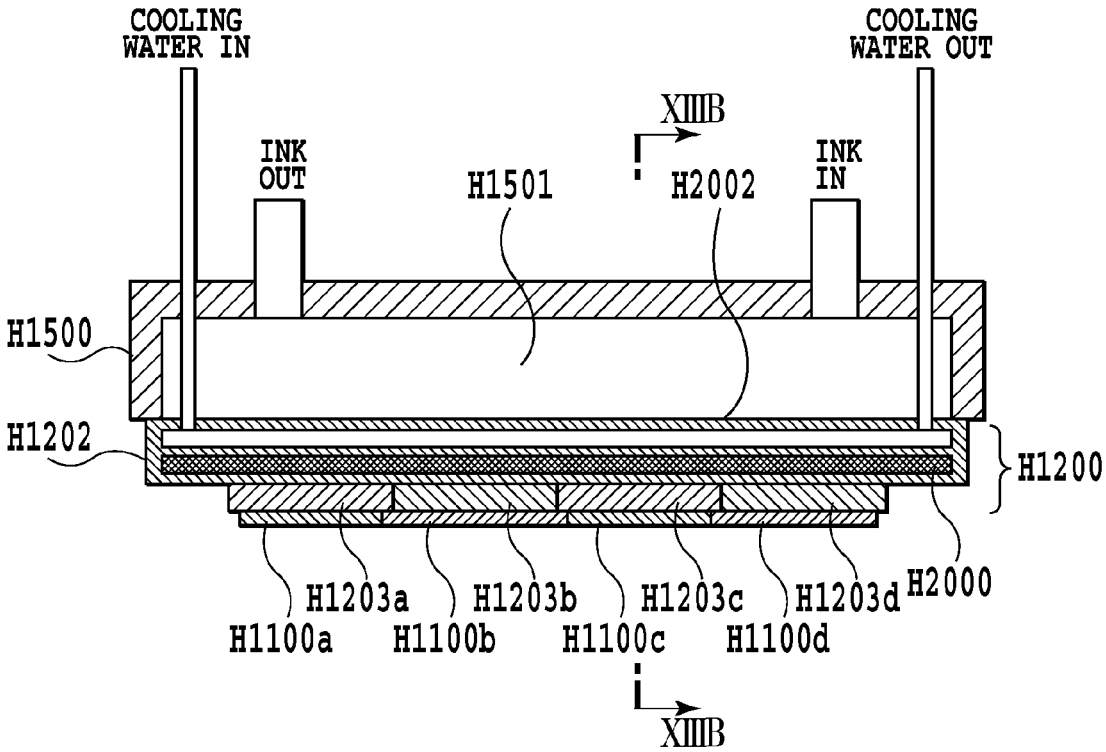
FIGS. 13A and 13B are cross-sectional schematic views of a print head according to a fifth embodiment of the present invention.
Figure 13B:
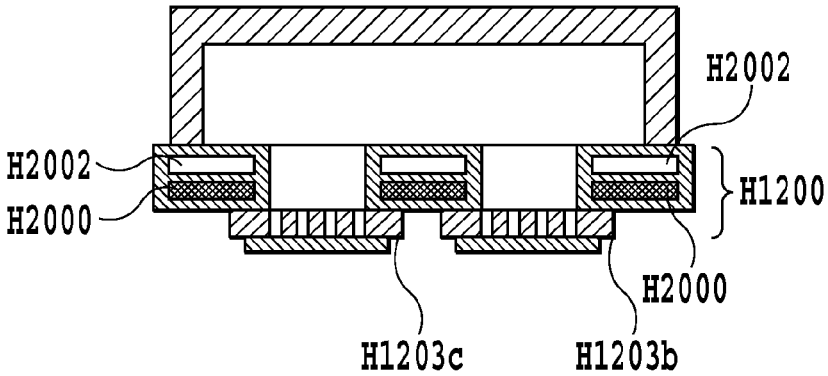

A fifth embodiment of the present invention relates to a case in which heat pipes are provided in an inside of the first support substrate similarly to the fourth embodiment, and a difference between the fourth embodiment and the fifth embodiment is that a passage for cooling liquid (cooling liquid passage) are also provided in an inside of the first support substrate. FIGS. 13A and 13B are schematic views showing cross-sections of an inkjet print head of the fifth embodiment. FIG. 13A is a longitudinal cross-sectional view and FIG. 13B is a cross-sectional view taken along line XIIIB-XIIIB of FIG. 13A. As shown in these figures, heat pipes H2000 and passages H2002 for cooling medium are formed in the inside of the first support substrate H1202.

Figure 14:
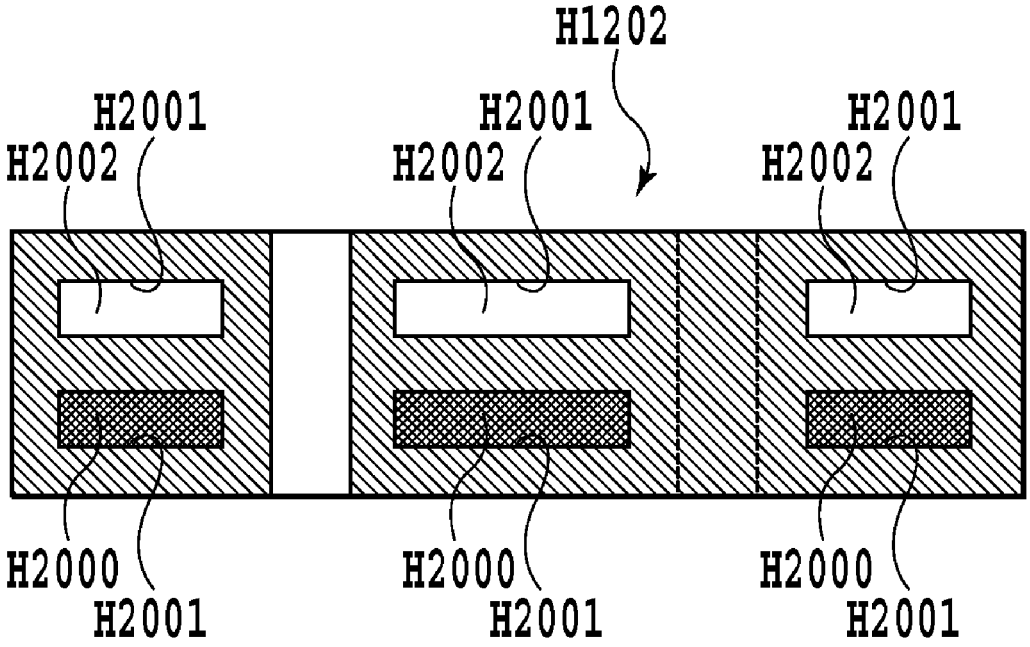
FIG. 14 is a view schematically showing only a first support substrate of the print head in FIG. 13.

FIG. 14 is a schematic view showing a transverse cross-section of only the first support substrate H1202. The first support substrate H1202 is formed by a green sheet laminating method using five alumina green sheets. On the first support substrate H1202, three holes are independently formed to form spaces H2001 for installing heat pipes H2000, respectively. Three holes are further independently formed to be parallel with the foregoing holes to thereby form passages H2002, thus allowing a cooling medium to flow. The shape of the space for installing a heat pipe and that of the heat pipe to be used are the same as those mentioned in the fourth embodiment. Moreover, each heat pipe H2000 is fixed to the first support substrate H1202 by filling a gap between the heat pipe H2000 and a hole wall with a silicon adhesive. A cross-section of each passage H2002 has a width of 3 mm and a depth of 2 mm in this embodiment. A flow rate of cooling liquid is set to about 20 ml/min to 100 ml/min. Any flow rate may be, of course, possible if it is suitable for a print execution condition and the specification of the print head.

Commercially available heat pipes can be used as the heat pipe H2000 of the fourth and fifth embodiments, similarly to the first embodiment. Regarding the shape of the pipe, a type of a pipe having a flattened cross-section is preferably used from the viewpoint of an increase in a contact area with the first support substrate H1202. Moreover, as a material that fills a gap between the heat pipe H2000 and a hole wall of the first support substrate H1202, any material may be possible if it is stable and has a high thermal conductivity, and a silicon-based adhesive or grease can be used.

Moreover, materials having rigidity, ink resistance, and good thermal conductivity are preferably used as the material of the first support substrate H1202 of the fourth and fifth embodiments, and ceramic materials are mainly used. Among the ceramic materials, particularly alumina costs relatively low and has rigidity, and therefore is suitable for a print head having an increased length in which warpage or waviness is likely to become a problem. Particularly, an alumina substrate formed by laminating and calcinating a green sheet is preferable since it can be manufactured at low cost even when it is used for the complicated structure as in the print head of the present invention. Furthermore, as compared with a comparative example (a structure in which, after calcination, grooves and supply ports are formed by grinding and in which three plates are bonded to one another with an adhesive), the print head of the present embodiment is preferable since an adhesive to serve as a heat insulation layer may not be used, thereby improving cooling and temperature equalizing of the print head.

Regarding arrangement of the heat pipes H2000 and the cooling liquid passages H2002 in the first support substrate H1202, it is preferable that the heat pipes H2000 and the cooling liquid passages H2002 be made as close as possible to the printing element substrates H1100, which are heat sources. Moreover, it is necessary the heat pipes perform temperature equalizing on a distribution of temperature of the support substrate with a good heat exchanging efficiency and a cooling liquid performs cooling, the distribution of temperature being partially increased by the temperature rise of the printing element substrate H1100, used in printing, among the plurality of printing element substrates. Accordingly, in the print head of the present embodiment in which heat pipes H2000 are made as close as possible to the printing element substrates H1100 of the support substrate H1200, and the cooling liquid passages H2002 are arranged with partition layers each formed therebetween, excellent cooling efficiency is obtained as compared with the print head of the fourth embodiment.

The above described structure makes it possible to reduce the distribution of a temperature difference in the print head and to suppress the temperature rise. As a result, even when printing is performed with high density at high speed, it is possible to prevent occurrence of partial density unevenness of ink and ink non-ejection and to print high quality image at high speed.

Additionally, in the case of installing only the heat pipes H2000, only an effect of temperature equalizing can be expected. However, there is a case in which no cooling is required depending on the print executing condition. However, in a case where continuous printing is executed at high speed, a cooling method is also required. Both structures of the heat pipes H2000 and the cooling liquid passages H2002 are thus provided, thereby making it possible to obtain a higher cooling effect.

In addition, water, ink, air, nitrogen gas, and the like can be used as a cooling medium, and particularly when a temperature-adjusted medium is used in a circulation manner, temperature management and control are facilitated. Moreover, in a case where the cooling liquid passage is divided into plurality of passages, it is possible to precisely control temperature of the print head on the basis of the direction to which the cooling liquid flows and the number of passages.

Only two out of four printing element substrates are driven to execute high-speed continuous printing using the inkjet print head of the fourth and fifth embodiments. As a result, the temperature of the printing element substrate, which is used in printing, and the temperature of the printing element substrate, which is not used in printing, are substantially equal owing to temperature equalizing; that is, no temperature unbalance is observed between the printing element substrates, unlike in the case of the conventional print head.

Sixth Embodiment

The second support substrate H1203 of the fourth and fifth embodiments can be formed by molding silicon carbide material, similarly to the third embodiment.

The thermal conductivity of silicon carbide is 200 W/m·K, which is higher than that of alumina of about 30 W/m·K. By this means, even when temperature of the printing element substrate rises, the heat can be released through the second support substrate H1203, so that the temperature rise of the print head can be further suppressed.

Figure 15:
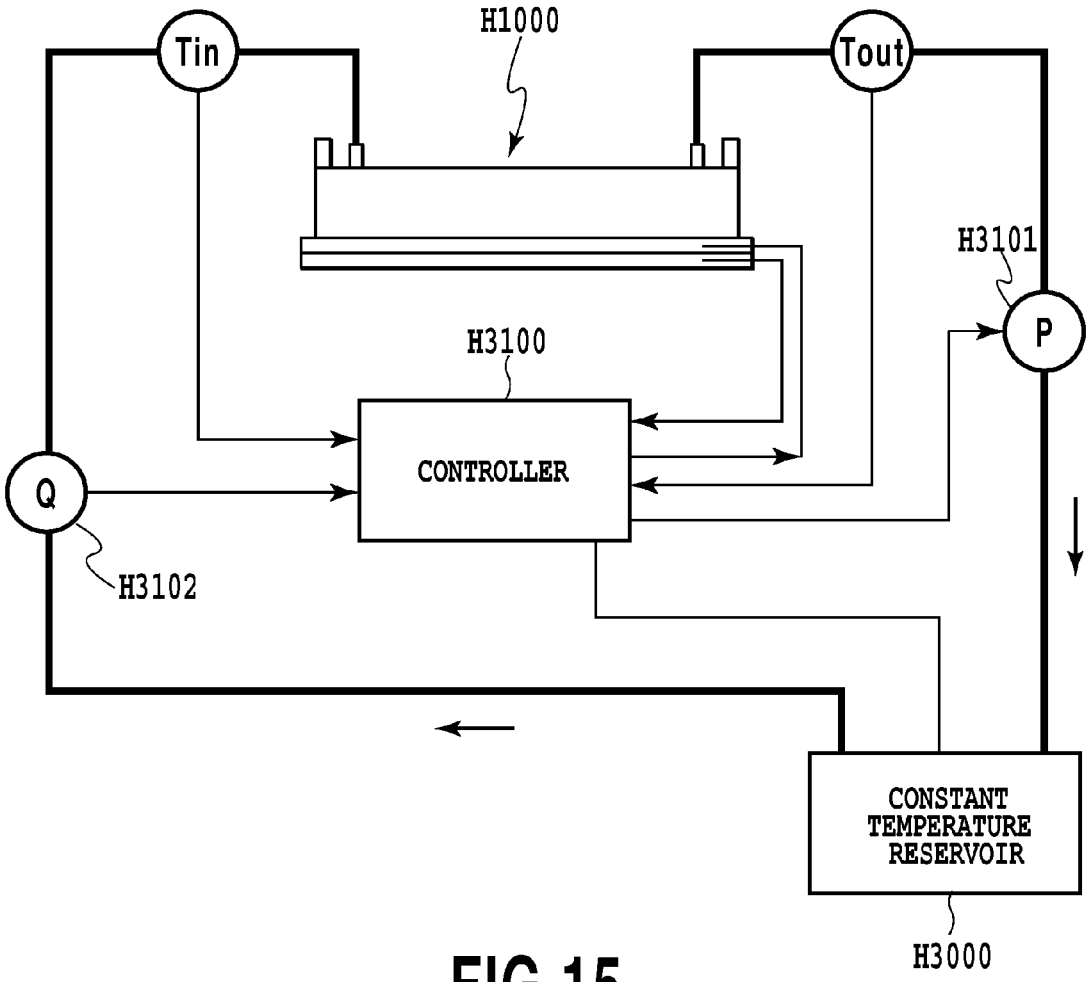
FIG. 15 is a view showing a structure of a cooling system according to one embodiment of the present invention.

FIG. 15 is a view showing a circulation structure of the cooling liquid of the foregoing first and fifth embodiments. As shown in the same figure, a cooling medium is sent to a cooling medium inlet of a print head H1000 by a pump H3101 and is returned to a constant temperature reservoir H3000 through the aforementioned cooling liquid passage in the print head. A controller H3100 of the printing apparatus monitors a flow rate of the cooling medium using a flowmeter H3102, and also monitors an inlet temperature of the print head, an outlet temperature thereof, and a print head temperature. Then, the controller H3100 performs adjustment of the flow rate, temperature adjustment of the constant temperature reservoir and the like according to a printing condition, an environmental temperature, and the like. Additionally, in a case where ink, namely, printing liquid is used as a cooling medium, the number of tanks can be set to one to allow a reduction in the size of the printing apparatus, as compared with a case where another medium is used.

As explained above, according to the embodiments of the present invention, it is possible to select both cases: one in which the first support substrate is manufactured by the green sheet laminating method to incorporate cooling pipe-works thereinto as one body, and the other in which two plates are bonded to each other to incorporate cooling pipe-works thereinto. The first support substrate and the second support substrate are bonded to each other and the resultant substrate is used as a support substrate for a print head, whereby the heat pipes and cooling pipe-works can be arranged at predetermined positions, and positional accuracy of the ink supply ports can be sufficiently ensured, and manufacturing at low cost can be achieved. Then, the heat pipes and the cooling liquid passages, serving as heat exchanging devices, can be arranged near the printing element substrates serving as heat sources. In addition to this, a contact area with the second support substrate, whose temperature rises by heat from the printing element substrate, can be ensured to be maximum to remarkably improve heat exchanging efficiency, thereby making it possible to exert an effect on cooling and temperature equalizing of the print head.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2007-309702, filed Nov. 30, 2007, 2007-311416, filed Nov. 30, 2007, and 2008-283335, filed Nov. 4, 2008, which are hereby incorporated by reference herein in their entirety.

What is claimed is:

1. An ink jet print head comprising:

a plurality of printing element substrates, on each of said plurality of printing element substrates a plurality of thermal energy generating elements for ejecting ink are formed;

a first support substrate;

a second support substrate supporting said plurality of printing element substrates and extending along an arrangement direction along which said plurality of printing element substrates are arranged, and said first support substrate supporting said second support substrate; and a heat pipe disposed between said first support substrate and said second support substrate or disposed inside said first support substrate and extending beyond an area on which said plurality of printing element substrates are arranged along the arrangement direction, said heat pipe being disposed on one and the other sides of a center line of directly opposite printing element substrates of said plurality of printing element substrates, the center line extending along the arrangement direction.

2. An ink jet print head as claimed in claim 1, further comprising a cooling liquid passage in which a cooling liquid flows and which is disposed inside said first support substrate.

3. An ink jet printing apparatus that mounts said ink jet print head as claimed in claim 2, the ink jet printing apparatus comprising:

a unit for causing flow of the cooling liquid in the cooling liquid passage disposed inside said first support substrate.

4. An ink jet printing apparatus as claimed in claim 3, further comprising a controller for controlling said unit for causing the flow of the cooling liquid to suppress temperature rise of said ink jet print head.

5. An ink jet printing apparatus as claimed in claim 3, wherein an ink is used as the cooling liquid flowing in the cooling liquid passage.

6. An inkjet print head as claimed in claim 2, wherein said heat pipe is disposed at a location nearer than said cooling liquid passage to said printing element substrates.

7. An ink jet print head as claimed in claim 1, wherein a thermal conductivity of said second support substrate is higher than that of said first support substrate.

8. An ink jet print head as claimed in claim 1, wherein said second support substrate is made of ceramic material.

9. An ink jet print head as claimed in claim 1, wherein said first support substrate is formed by laminating green sheets and calcining the laminated green sheets.

10. An ink jet print head as claimed in claim 1, wherein said second support substrate is formed by a molding method.

11. An ink jet print head as claimed in claim 1, wherein said plurality of printing element substrates are arranged in a staggered manner.

12. An ink jet printing apparatus that mounts said print head as claimed in claim 1 and performs printing by ejecting ink from said print head.

13. An ink jet print head comprising:

a plurality of printing element substrates, on each of said plurality of printing element substrates, a plurality of thermal energy generating elements for ejecting ink are formed;

a support substrate supporting said plurality of printing element substrates and extending along an arrangement direction along which said plurality of printing element substrates are arranged; and at least one of a heat pipe and a cooling liquid passage in which a cooling liquid flows extending beyond an area on which said plurality of printing element substrates are arranged along the arrangement direction and being disposed on one and the other sides of a center line of directly opposite printing element substrates of said plurality of printing element substrates, the center line extending along the arrangement direction.

14. An ink jet print head as claimed in claim 13, wherein said at least one of said heat pipe and said cooling liquid passage is longer than said support substrate in the arrangement direction.

* * * * *